US006857820B2

(12) United States Patent
Jacoway et al.

(10) Patent No.: US 6,857,820 B2
(45) **Date of Patent: *Feb. 22, 2005**

(54) DIVING BACK PLATE

(75) Inventors: William W. Jacoway, San Diego, CA (US); Robert B. Jacoway, Poway, CA (US)

(73) Assignee: Deepoutdoors, LLC, Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/377,445

(22) Filed: Feb. 28, 2003

(65) Prior Publication Data

US 2004/0082238 A1 Apr. 29, 2004

Related U.S. Application Data

(60) Provisional application No. 60/360,996, filed on Mar. 1, 2002.

(51) Int. Cl.[7] ..... B63C 11/02

(52) U.S. Cl. ..... 405/186; 405/185; 405/187; 224/627; 224/637; 224/934; D21/804; D21/801; D21/354

(58) Field of Search ..... 405/185–187; 224/627, 628, 629, 637, 639, 148.1, 148.4, 934, 148.7, 153; 114/315

(56) References Cited

U.S. PATENT DOCUMENTS 3,774,825 A * 11/1973 Schone et al. ..... 224/265
3,891,131 A * 6/1975 Tabata ..... 224/628
3,957,183 A * 5/1976 Gadberry ..... 224/628
4,310,110 A * 1/1982 Dexter ..... 224/246
4,455,718 A * 6/1984 Finnern ..... 405/186
4,690,314 A * 9/1987 Faulconer et al. ..... 224/628
4,934,573 A * 6/1990 Jaeger ..... 224/628
D319,778 S * 9/1991 Ziaylek, Jr. ..... D8/373
5,363,790 A * 11/1994 Matsuoka ..... 114/315
5,567,084 A * 10/1996 Oliver ..... 405/186
5,607,258 A * 3/1997 Eungard ..... 405/186
5,836,489 A * 11/1998 Swetish ..... 224/262
5,902,073 A * 5/1999 Eungard et al. ..... 405/187
5,913,467 A 6/1999 Berg
5,954,253 A 9/1999 Swetish
D415,013 S * 10/1999 Griffiths ..... D8/354
6,120,213 A * 9/2000 Stinton ..... 405/186
6,367,753 B1 * 4/2002 Berg ..... 248/222.11
6,409,429 B1 * 6/2002 Belloni ..... 405/186
D468,792 S * 1/2003 Jacoway et al. ..... D21/804
6,503,114 B2 * 1/2003 Kawashima et al. ..... 441/116

FOREIGN PATENT DOCUMENTS

JP 06270887 * 9/1994 ..... 405/185

OTHER PUBLICATIONS

Custom Divers, http://www.customdivers.com/tcwwing7.html, undated, (5 pages, printed May 8, 2003).

* cited by examiner

*Primary Examiner*—Jong-Suk (James) Lee
(74) *Attorney, Agent, or Firm*—Gordon & Rees LLP

(57) ABSTRACT

A diving back plate designed with independent shoulder and waist straps. The diving back plate accommodates either a single tank or double tank configuration without the need for an adapter. The independent straps are self-fastening to the back plate through a series of throughslots on the back plate. Items and accessories may be permanently attached to the independent straps while the straps remain fully adjustable and removable. The configuration of the back plate, throughslots, and throughbores eliminate the need for adapters when changing between a single tank configuration and a double tank configuration.

15 Claims, 1 Drawing Sheet

DIVING BACK PLATE

CROSS-REFERENCES TO RELATED APPLICATIONS

This application claims the benefit of priority of U.S. provisional application Ser. No. 60/360,996 filed Mar. 1, 2002 which is incorporated herein by reference in its entirety.

BACKGROUND

This invention relates to an improved back plate to be worn by underwater divers.

A back plate is a device for carrying one or more tanks of breathing gas on the back of the diver to allow them to breathe while underwater. The self contained underwater breathing apparatus ("SCUBA") or other tank is attached to the back plate which is worn by the diver either via a separate harness device attached to the back plate or via shoulder webbing straps and waist webbing straps connected directly to the back plate. Typically, the shoulder straps and waist straps attached directly to the back plate consist of a single webbing strap that is woven through slots in the back plate to form the right shoulder strap, the left shoulder strap, and the waist strap. One drawback of this type of single, continuous webbing strap configuration is the inability to adjust the right and left shoulder straps independently. An additional drawback of the single, continuous webbing strap configuration is that equipment loops or other accessories cannot be attached permanently to the shoulder straps because this permanent attachment of accessories would not allow for the single strap to be threaded through the back plate slots. If such accessories are permanently attached after the strap is threaded through the back plate, then the strap cannot be removed.

Yet another drawback to the single, continuous webbing strap configuration is that the portion of the webbing strap that comprises the shoulder harness straps is not adjustable beyond the tightening of the entire strap system. Tightening or loosening the webbing strap does not adequately accommodate for the many different sizes and shapes of divers that use a back plate webbing strap system. Tightly fastening a rigid metal sheet to the back of a diver or loosely fastening the same metal sheet without adjustment may result in discomfort and therefore diminish the enjoyment of the experience of diving.

Back plates that are primarily designed for use with double cylinders, or scuba tanks, are known in the art. These back plates can typically be converted for use with a single tank configuration only through the attachment of an adapter. The need for the addition of a separate adapter when switching between a double tank configuration and a single tank configuration is inconvenient and inefficient.

An obvious need exists for a back plate that allows for attachment of independent shoulder and waist straps and thus, permanent attachment of accessories to the straps. Additionally, a need for a back plate that allows for convenient configuration of double and single tank arrangements without the use of a separate adapter is evident.

SUMMARY OF THE INVENTION

It is an object of the present invention to provide an underwater diving back plate designed for attachment of shoulder straps that allow for improved adjustability.

It is another object of the present invention to provide an underwater diving back plate that allows for attachment of independent shoulder and waist straps.

It is a further object of the present invention to provide an underwater diving back plate that allows for permanent attachment of equipment to the shoulder straps while also allowing for removal and reattachment of the shoulder straps.

It is yet another object of the present invention to provide a back plate designed for use with a two tank configuration or a single tank configuration without the need for an adapter.

These and other features, aspects, and advantages of the present invention will become better understood with regard to the following description, appended claims, and accompanying drawings.

DESCRIPTION

Figure 1:
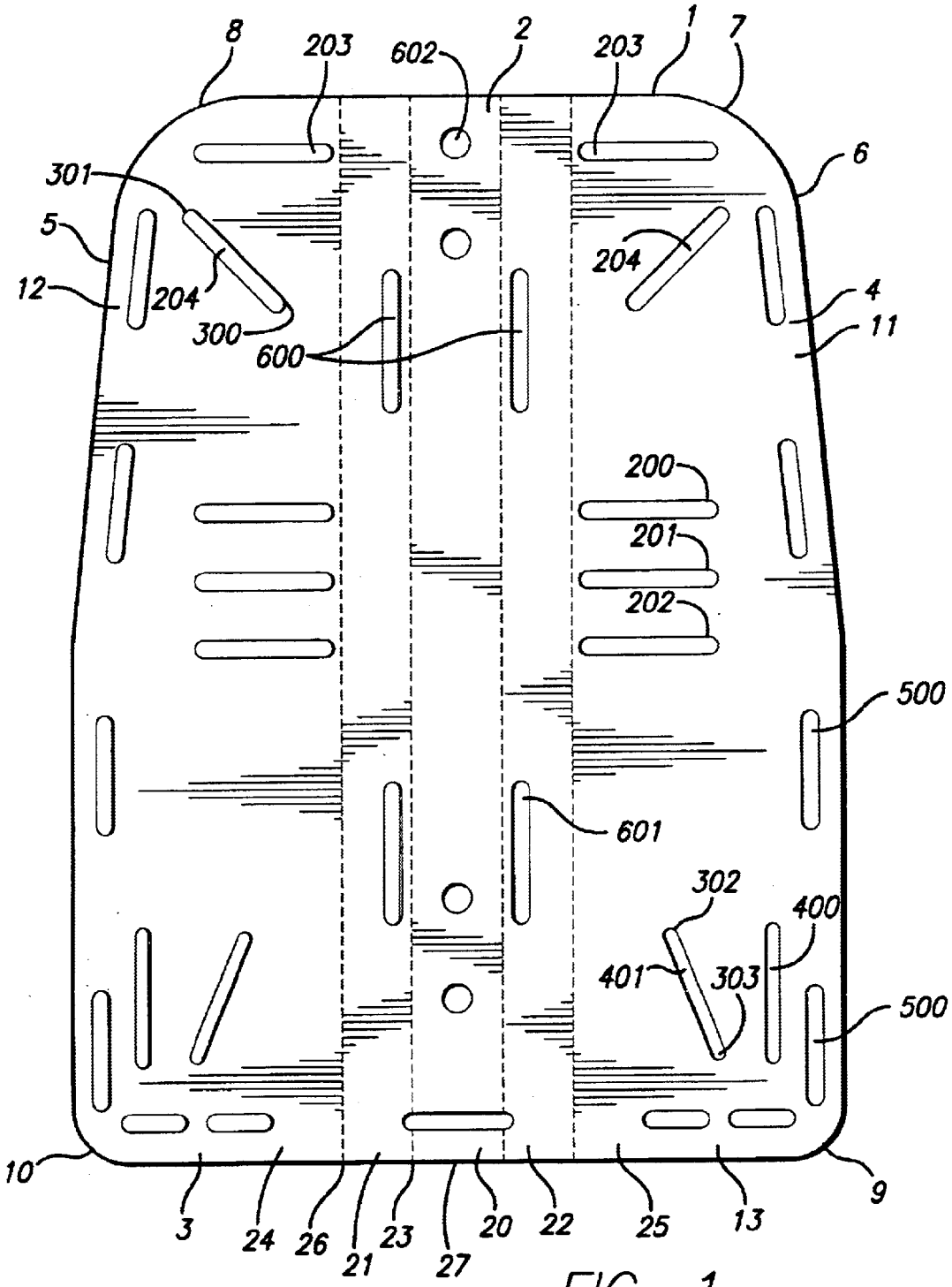
FIG. 1 illustrates a frontal view of the present invention.

Referring to FIG. 1, a frontal view of the diving back plate 1 is shown. The back plate 1 is constructed of a sheet of stainless steel, aluminum, titanium, other metals, rigid plastic, carbon fiber, Kevlar or other resilient, rigid material suitable for use as a diving back plate. The back plate is an angled sheet with a top portion 2, a bottom portion 3, and an outside periphery portion 4. The outside portion 4 has a left side portion 5, a right side portion 6 and an opposing top right corner 7 and top left corner 8 as well as an opposing bottom right corner 9 and bottom left corner 10.

The back plate also has a central and generally planar portion 20. The dashed lines and describe changes in the plane, or bends and resulting angles, of the back plate between portions of the back plate. Two portions of the back plate directly adjacent to the central portion include a generally planar first side portion 21 and generally planar second side portion 22 with bends and first angles 23. The dashed line defines two first angles 23 that create a non-parallel and generally converse orientation to form a flat-bottomed "V" shape. Directly adjacent to the first and second side portions is a generally planar third side portion 24 meeting the first side portion 21 and a generally planar fourth side portion 25 that meets the second side portion 22. The third side 24 and the fourth side portions 25 are also angled in non-parallel and generally converse orientations with bends and second angles 26. The second angles 26 comprise a lesser degree than the first angles 23. Although different angles may be used, in a preferred embodiment the first angles 23 should be congruent angles in a converse configuration and the second angles 26 should be congruent angels in a converse configuration so that the present back plate 1 is symmetrical along its longitudinal axis 27 within the central portion 20 parallel to the first angle bend 23 and second angel bend 26.

Figure 2:
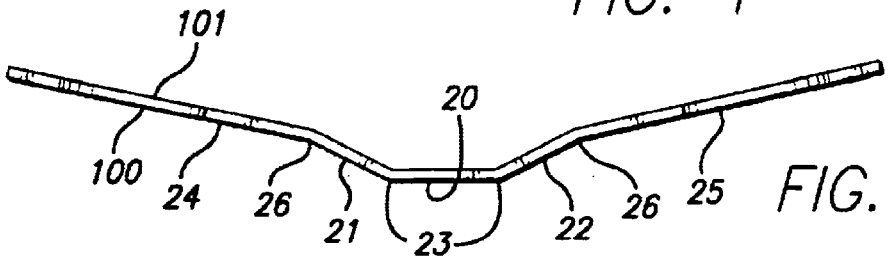
FIG. 2 illustrates a side view of the bottom, looking from the bottom to the top, of the present invention illustrating the angles and the various sections of the back plate.

Referring now to FIG. 2, a bottom view of the back plate 1 is shown. The first angle 23 and second angle 26 and the changes in the plane of the back plate 1 are clearly shown in this bottom view of the back plate. The first angle 23 between back plate section and each of the two back plate sections can vary between greater than one degree and less than ninety degrees, with a preferred angle being approximately thirty-three degrees. The second angle 26 between the back plate sections and the back plate sections can vary between one degree and ninety degrees, with a preferred angle being approximately twenty-one degrees. In a preferred embodiment, the changes in plane of the sheet result in the back plate having a gull-wing configuration.

The convex side 100 of the sheet formed by the first angles 23 and second angles 26 is meant to face away from the diver and is the dorsal and back side of the back plate. The opposite, and concave, side 101 of the sheet is meant to be worn facing towards the diver and is the ventral and front side of the back plate.

Referring now to FIG. 1, the third side 24 and the fourth side 25 each have a plurality of throughslots. Among the plurality of throughslots are three of pair of horizontal throughslots 200, 201 and 202 positioned in the upper middle portion of the back plate on the third side 24 and fourth side 25, designed so that one member of each pair of throughslots is on the third side and the second member of the pair is on the fourth side. Each column of these horizontal throughslots, numbered 200, 201 and 202, is designed to be releasably engaged by a shoulder strap. The shoulder strap is threaded through the slots in such a fashion so as to hold the strap in place without the need for an additional fastener means. In a preferred embodiment, the two columns of parallel throughslots 200, 201, and 202 comprise the means for securing each strap independently to the back plate.

A pair of horizontal shoulder strap throughslots 203 is parallel to and close to the top outside periphery 4 of the back plate 1 with one member of the pair on the third side 24 and the other member of the pair on the fourth side 25. Another pair of shoulder strap throughslots is positioned diagonally, thus diagonal shoulder strap throughslots 204, near the top right and top left corners 7 and 8 with a first member of the pair on the third side 24 and the second member of the pair on the fourth side 25. The inside edge portions 300 of the diagonal shoulder strap throughslots 204 are oriented toward the central back plate portion 20. One of the outside edge portions 301 of the diagonal shoulder strap throughslots 204 is oriented towards the top right corner portion 7 and the other towards the top left corner portion 8. An example of a method for threading the shoulder strap through the back plate slots includes, but is not limited to, threading one end of a shoulder strap through the slots in the following order: 203, 201, 200, 204, back through 201, and then back through 203. Although a preferred order of threading the webbing is set forth, there are additional threading patterns through the parallel slots 203 through 202 which will hold the webbing in place without the need for additional fasteners, and the scope of one advantage of this invention is intended to encompass all such threading configurations.

The back plate also has waist strap attachments, preferably throughslots. These waist strap throughslots include a vertical pair of throughslots parallel to the central portion 400. The vertical waist strap throughslots 400 are in the left and right outside periphery portions 4, close to the bottom corner portions 9 and 10. One member of the pair of vertical waist strap throughslots 400 is on the third side 24 and the other member of the pair on the fourth side 25. Also, additional waist strap throughslots are positioned diagonally, thus diagonal waist strap throughslots 401, relative to the back plate and near the bottom right and bottom left corners 9 and 10 on the third side 24 and the fourth side 25. The inside edge portions 302 of the diagonal waist strap throughslots 401 are oriented toward the central back plate portion 20. One of the outside edge portions 303 of the diagonal waist strap throughslots 401 is oriented toward the bottom right corner portion 9 and 10 the other towards the bottom left corner portion 10. One member of the pair of diagonal waist strap throughslots is on the third side 24 and the second member of the pair of diagonal waist strap throughslots is on the fourth side 25. In one embodiment, a right and a left shoulder strap are threaded through the right and left throughslots 200 and 203 and then through slots 401 and finally slot 400, respectively, to form the independent right shoulder and waist strap as well as the independent left shoulder and waist strap. Another embodiment includes the above arrangement and adds a second waist strap with right and left sides involving throughslots 500 near the bottom corners. Thus, the waist straps are designed so that several methods may be used to fasten the waist straps around the waist of the wearer with a suitable fastener.

Pluralities of pairs of throughslots 500 are positioned linearly and close to the bottom, right and left outside portions 4 of the back plate 1. Some of these throughslots are positioned vertically along the right outside periphery portion 11, some along the left outside periphery portion 12, and still others are positioned horizontally along the bottom outside periphery portion 13. The pairs of throughslots parallel to the outside right and left periphery portions are symmetrically positioned relative to the longitudinal axis 27 with one member of the pair on the right outside periphery portion and the corresponding member of the pair on the left outside periphery portion. Additionally, at least one throughslot is positioned parallel to the outside bottom periphery portion 13 on the central portion 20 of the back plate.

Two different types of throughholes (throughslots and throughbores) are used to secure scuba cylinder tanks to the back plate. The vertical pairs of throughslots 600 and 601 are positioned linearly and vertically along the first side portion 21 and the second side portion 22 in a converse configuration so that the first member of each pair is on the first side and the second member of the pair is on the second side. At least one strap is threaded through at least one pair of throughslots 600 and 601, around a scuba tank, and finally fastened in order to secure the scuba cylinder tank to the back plate. The four linear throughbores 602 along the central portion are used for the attachment of a set of dual scuba tanks. The throughbores 602 are designed to be releasedly engaged by a nut and bolt assembly, which, in turn are used to fasten the dual tanks to the back plate 1.

Although the preferred configuration is shown, the number of throughholes and their locations can be varied to achieve the same result, and the scope of this invention is intended to encompass all such configurations.

It is therefore an advantage of the present invention of a back plate to offer a custom fit and configuration back plate. The ability to change shoulder strap configurations allows a diver to adjust the points of attachment of the shoulder and waist straps to the back plate. This adjustability of strap placement allows the back plate and straps to fit different body types and sizes. Also, the use of two independent straps, one for the right shoulder and waist strap and one for the left shoulder and waist strap, provide for a more comfortable and better fit as compared to the typical single, continuous strap. The independent straps of the present back plate invention allow for multiple strap configurations and independent adjustment of each side of the straps.

A further advantage of the present invention provides for the ability to permanently attach items to the shoulder straps without also making the placement of the shoulder straps permanent. The present invention is designed for two independent straps to attach to the present back plate invention by threading a free end of each strap though one of two sections of unique throughslots, creating a self-tightening and secure attachment on the back plate before the straps comprise the shoulder and waist straps. This allows for permanent attachment of multiple configurations of items to the straps while allowing the straps to be adjusted, and likely completely removable, with a unique fastening means of self-tightening loops. Permanent attachment of items to the straps ensures that items are always in the same place, especially for technical divers who may attach equipment for dives involving caves and wrecks that involve more expertise and equipment than non-tech diving. This also allows such equipment to be securely and permanently attached to the straps, reducing the chance of the attached equipment from being dislodged from the straps and therefore potentially unavailable or even lost.

Yet another advantage of the present invention of a back plate includes the option to use either a single scuba tank or a dual scuba tank configuration without the need for an extra adapter. Frequently, a separate adapter device is required to attach a single tank to a double tank back plate. The configuration of the back plate as well as the placement of throughbores and throughslots provides for easy attachment of either a single or double tank configuration without the need for an additional adapter.

It is important to note, however, that the invention does not require that all these advantages need be incorporated into every embodiment of the invention.

An embodiment of the present invention is directed to a diving back plate apparatus that allows for the attachment of independent right and left shoulder straps that can be independently adjusted. One embodiment of the present invention is constructed of stainless steel or aluminum and incorporates one or more parallel columns of horizontal throughslots in the mid section of the back pack, each column comprising a plurality of guide means for use in attaching variable fit shoulder straps to the back plate by threading the straps, preferably webbing straps, through the guide means. A separate strap is used for each of the right and left sides. A preferred embodiment includes two parallel columns of horizontal slots, each column comprising three parallel slots as the guide means through which the shoulder straps, are threaded and which secures the shoulder straps to the back plate without the need for any additional fastening means such as a buckles, hook and loop fasteners, rivets or other means. The shoulder straps can comprise any suitably resilient material, including, but not limited to, two-inch nylon webbing.

The guide means for the shoulder strap webbing, while shown as throughslots in the back plate, could compromise other structures including, but not limited to, throughholes of any shape, attachments, rings, loops or any other structure that allow the straps to be threaded through them. The straps means do not necessarily have to penetrate the back plate. In fact, any structure which allows the strap to be passed through a series of such structures and which results in the shoulder strap being held in place without the need for additional fastening means may be used. It should be understood that the use of throughslots is merely a preferred embodiment.

Although a preferred embodiment includes the columns of throughslots on the upper middle section of the back plate with one member of the pair on the right side and the other member of the pair on the left side of the back plate, this placement may vary. The use of the throughslots for attachment allows each of the harness straps to be attached to the back plate independently and to be adjusted easily for a custom fit. Additionally, the straps can be independently and easily removed from the back plate. Installation and removal of the straps can usually be accomplished even if there are permanently attached equipment loops or accessories on the strap because only the ends of the straps have to pass through and releasably engage the throughslots in the back plate. Adjustment is accomplished by changing the amount of webbing threaded through the back plate throughslots. After threading one end of a strap through the three parallel throughslots, the strap is then threaded through a plurality of additional throughslots to form one of the shoulder straps and one of the waist straps, resulting in either a right or left shoulder strap and a right side or left side of the waist strap, respectively.

Additional throughslots are positioned about the periphery of the back plate to accommodate other equipment, variations of shoulder strap configurations, variation of waist strap configurations, or a combination involving the use of the additional throughslots or attachment sites, depending on their use.

Although the present invention has been described in considerable detail with reference to certain preferred versions thereof, other versions are possible. All of the features disclosed in this specification and drawings may be replaced by alternative features serving the same, equivalent or similar purpose, unless expressly stated otherwise. Therefore, the spirit and scope of this specification should not be limited to the description of the preferred versions contained herein.

We claim:

1. A back plate for use in SCUBA applications, comprising:

a. an angled sheet with a top portion, a bottom portion, an outside periphery portion, said outside periphery portion having both a left side portion and a right side portion, said outside periphery portion also having an opposing top right corner and top left corner as well as an opposing bottom right corner and bottom left corner, said sheet having a central and generally planar portion with adjacent and opposing first and second side portions, said adjacent first side portion being generally planar and an adjacent second side portion being generally planar, and both said first side and said second side meeting said central portion of said angled sheet in a non-parallel and converse orientation with congruent first angles to form a flat-bottomed "V" shape, said angled sheet also having and a third side planar portion meeting said first side portion and a fourth side planar portion meeting said second side portion, said third side and said fourth side portions angled in non-parallel converse orientations with congruent second angles to form a faceted general "V" shape;

b. a plurality of pairs of horizontal strap attachments positioned closer to said top portion of said sheet than said bottom portion of said sheet, said pairs of strap attachments residing in columns on said third side and said fourth side and designed so that a first member of each said pair of horizontal strap attachments resides on said third side in a column and a second member of said pair of horizontal strap attachments resides on said fourth side in a column;

c. a plurality of pairs of strap attachments aligned generally linear and generally vertical along said left side portion and said right side portion, designed so that a first member of each said pair of vertical and linear strap attachments resides on said third side and a second member of said pair of vertical and linear strap attachments resides on said fourth side;

d. a plurality of pairs of cylinder strap attachments positioned linearly and vertically along said first side portion and said second side portion and designed so that one member of each said pair of vertical and linear cylinder strap throughslots resides on said first side portion and the second member of said pair of vertical and linear cylinder strap throughslots resides on said second side portion;

e. a plurality of dual cylinder attachments positioned linearly along said central portion of said sheet;

f. a plurality of pairs of diagonal shoulder and waist strap attachments, each of said diagonal attachments with an inside edge portion and an outside edge portion and designed such that said inside edge portion of each of said diagonal attachment is oriented closest to said central portion of said sheet and said outside edge portion of said diagonal attachment is oriented closest to said outside portion of said sheet, said shoulder strap attachments designed to reside near said top right and said top left corners on said third side and said fourth side, respectively, said diagonal shoulder strap attachments further designed so that a first member of each pair of diagonal shoulder strap attachments resides on said third side and a second member of said pair of diagonal shoulder strap attachments resides on said fourth side, said diagonal waist strap attachments designed to reside near said bottom right and said bottom left corners on said third side and said fourth sides, respectively, and further designed so that a first member of each pair of diagonal waist strap attachments resides on said third side and a second member of said pair of diagonal waist strap attachments resides on said fourth side;

g. a pair of horizontal shoulder strap attachments, parallel to said top edge portion, designed to reside parallel and close to said top outside periphery portion on said third side and said fourth side and further designed such that a first member of said pair of said horizontal shoulder strap attachments resides on said third side and a second member of said pair of horizontal shoulder strap attachments resides on said fourth side;

h. a pair of vertical waist strap attachments, designed to reside parallel to said left and right outside periphery portions and close to said bottom corner portions on said third side and said fourth side, said vertical waist strap attachments further designed so that a first member of said pair of vertical waist strap attachments resides on said third side and a second member of said pair of vertical waist strap attachments resides on said fourth side;

i. a plurality of strap attachments oriented parallel to said periphery portion of said sheet on said third side, said forth side and said central portion.

2. The back plate of claim 1, said second angles comprising a lesser degree than said first angles.

3. The back plate of claim 2, said back plate comprising of one of the following group consisting of stainless steel, aluminum, plastic, titanium, carbon fiber, Kevlar, or any other suitable metals.

4. The back plate of claim 3, said attachments comprising three pair.

5. The back plate of claim 3, said attachments comprising throughslots.

6. The back plate of claim 5, said throughslots designed to eliminate sharp edges that may damage webbing.

7. A back plate for use in SCUBA applications, comprising:

a. an angled sheet with a top portion, a bottom portion, and an outside periphery portion, said outside periphery portion having both a left side portion and a right side portion, said outside periphery portion also having an opposing top right corner and top left corner as well as an opposing bottom right corner and bottom left corner, said sheet having a central and generally planar portion with adjacent and opposing first and second side portions, said adjacent first side portion being generally planar and said adjacent second side portion being generally planar, and both said first side and said second side meeting said central portion of said angled sheet in a non-parallel and converse orientation with congruent first angles to form a flat-bottomed "V" shape, said angled sheet also having and a third side planar portion meeting said first side portion and a fourth side planar portion meeting said second side portion, said third side and said fourth side portions angled in non-parallel converse orientations with congruent second angles to form a faceted general "V" shape;

b. a plurality of pairs of horizontal throughslots positioned closer to said top portion of said sheet than said bottom portion of said sheet, said pairs of throughslots residing in columns on said third side and said fourth side and designed so that a first member of each said pair of horizontal throughslots resides on said third side in a column and a second member of said pair of horizontal throughslots resides on said fourth side in a column;

c. a plurality of pairs of throughslots aligned generally linear and generally vertical along said left side portion and said right side portion, designed so that a first member of each said pair of vertical and linear throughslots resides on said third side and a second member of said pair of vertical and linear throughslots resides on said fourth side;

d. a plurality of pairs of cylinder strap throughslots positioned linearly and vertically along said first side portion and said second side portion and designed so that one member of each said pair of vertical and linear cylinder strap throughslots resides on said first side portion and the second member of said pair of vertical and linear cylinder strap throughslots resides on said second side portion;

e. a plurality of dual cylinder throughbores positioned linearly along said central portion of said sheet;

f. a plurality of pairs of diagonal shoulder and waist strap throughslots, each of said diagonal throughslots with an inside edge portion and an outside edge portion and designed such that said inside edge portion of each of said diagonal throughslot is oriented closest to said central portion of said sheet and said outside edge portion of said diagonal throughslot is oriented closest to said outside portion of said sheet, said diagonal shoulder strap throughslots designed to reside near said top right and said top left corners on said third side and said fourth side, respectively, said diagonal shoulder strap throughslots further designed so that a first member of each pair of said diagonal shoulder strap throughslots resides on said third side and a second member of said pair of said diagonal strap throughslots resides on said fourth side, said diagonal waist strap throughslots designed to reside near said bottom right and said bottom left corners on said third side and said fourth sides, respectively, and further designed so that a first member of each pair of diagonal waist strap throughslots resides on said third side and a second member of said pair of diagonal waist strap throughslots resides on said fourth side;

g. a pair of horizontal shoulder strap throughslots, parallel to said top edge portion, designed to reside parallel and close to said top outside periphery portion on said third side and said fourth side and further designed such that a first member of said pair of said horizontal shoulder strap throughslots resides on said third side and a second member of said pair of horizontal shoulder strap throughslots resides on said fourth side;

h. a pair of vertical waist strap throughslots, designed to reside parallel to said left and right outside periphery portions and close to said bottom corner portions on said third side and said fourth side, said vertical waist strap throughslots further designed so that a first member of said pair of vertical waist strap throughslots resides on said third side and a second member of said pair of vertical waist strap throughslots resides on said fourth side;

i. a plurality of strap throughslots oriented parallel to said periphery portion of said sheet on said third side, said forth side and said central portion.

8. The back plate of claim 7, said second angles comprising a lesser degree than said first angles.

9. The back plate of claim 8, said back plate comprising of one of the following group consisting of stainless steel, aluminum, plastic, titanium, carbon fiber, Kevlar, or any other suitable metals.

10. The back plate of claim 9, said attachments comprising three pair.

11. The back plate of claim 10, said throughslots designed to eliminate sharp edges that may damage webbing.

12. The back plate of claim 7, said thorughbore designed to be releasedly engaged by a nut and bolt assembly.

13. A back plate for use in SCUBA applications, comprising:

a. an angled sheet with a top portion, a bottom portion, a outside portion, and an outside periphery portion, said outside periphery portion having both a left side portion and a right side portion, said outside periphery portion also having an opposing top right corner and top left corner as well as an opposing bottom right corner and bottom left corner, said sheet having a central and generally planar portion with adjacent and opposing first and second side portions, said adjacent first side portion being generally planar and said adjacent second side portion being generally planar, and both said first side and said second side meeting said central portion of said angled sheet in a non-parallel and converse orientation with congruent first angles to form a flat-bottomed "V" shape, said angled sheet also having and a third side planar portion meeting said first side portion and a fourth side planar portion meeting said second side portion, said third side and said fourth side portions angled in non-parallel converse orientations with congruent second angles to form a faceted general "V" shape;

b. three of pair of horizontal throughslots positioned closer to said top portion of said sheet than said bottom portion of said sheet, said pairs of throughslots residing in columns on said third side and said fourth side and designed so that a first member of each said pair of horizontal throughslots resides on said third side in a column and a second member of said pair of horizontal throughslots resides on said fourth side in a column, each column of said horizontal throughslots designed to be releasably engaged by a strap;

c. a plurality of pairs of throughslots aligned generally linear and generally vertical along said left side portion and said right side portion, designed such that a first member of each said pair of vertical and linear throughslots resides on said third side and a second member of said pair of vertical and linear throughslots resides on said fourth side;

d. a plurality of pairs of cylinder strap throughslots positioned linearly and vertically along said first side portion and said second side portion and designed so that one member of each said pair of vertical and linear cylinder strap throughslots resides on said first side portion and the second member of said pair of vertical and linear cylinder strap throughslots resides on said second side portion;

e. a plurality of dual cylinder throughbores positioned linearly along said central portion of said sheet, said thorughbores designed to be releasedly engaged by a nut and bolt assembly;

f. a plurality of pairs of diagonal shoulder and waist strap throughslots, each of said diagonal throughslots with an inside edge portion of each and an outside edge portion and designed such that said inside edge portion of each of said diagonal throughslots is oriented closest to said central portion of said sheet and said outside edge portion in each of said diagonal throughslots is oriented closest to said outside portion of said sheet, said diagonal shoulder strap throughslots designed to reside near said top right and said top left corner on said third side and said fourth side, respectively, said diagonal shoulder strap throughslots further designed so that a first member of each pair of said diagonal strap throughslots resides on said third side and a second member of said pair of diagonal strap throughslots resides on said fourth side, said diagonal waist strap throughslots designed to reside near said bottom right and said bottom left corners on said third side and said fourth sides, respectively, and further designed so that a first member of each pair of diagonal waist strap throughslots resides on said third side and a second member of said pair of diagonal waist strap throughslots resides on said fourth side;

g. a pair of horizontal shoulder strap throughslots, parallel to said top edge portion, designed to reside parallel and close to said top outside periphery portion on said third side and said fourth side and further designed such that a first member of said pair of said horizontal shoulder strap throughslots resides on said third side and a second member of said pair of horizontal shoulder strap throughslots resides on said fourth side;

h. a pair of vertical waist strap throughslots, designed to reside parallel to said left and right outside periphery portions and close to said bottom corner portions on said third side and said fourth side, said vertical waist strap throughslots further designed so that a first member of the said pair of vertical waist strap throughslots resides on said third side and a second member of said pair of vertical waist strap throughslots resides on said fourth side;

i. a plurality of strap throughslots oriented parallel to said periphery portion of said sheet along said third side, said forth side and said central portion.

14. The back plate of claim 13, said back plate comprising of one of the following group consisting of stainless steel, aluminum, plastic, titanium, carbon fiber, Kevlar, or any other suitable metals.

15. The back plate of claim 14, said throughslots designed to eliminate sharp edges that may damage webbing.

* * * * *